United States Patent [19]

Mrvos et al.

[11] Patent Number: 5,059,045

[45] Date of Patent: Oct. 22, 1991

[54] RIBBON CARTRIDGE HAVING HYBRID INK RE-INKING

[75] Inventors: James M. Mrvos; Jeffrey H. Paterra; Agnes K. Zimmer, all of Lexington, Ky.

[73] Assignee: Lexmark International, Inc., Greenwich, Conn.

[21] Appl. No.: 542,616

[22] Filed: Jun. 25, 1990

[51] Int. Cl.[5] ..... B41J 32/00

[52] U.S. Cl. ..... 400/197; 400/202.1; 400/202.4

[58] Field of Search ..... 400/196, 196.1, 197, 400/202, 202.1, 202.2, 202.4, 208

[56] References Cited

U.S. PATENT DOCUMENTS

| | | | |
|---|---|---|---|
| 2,599,561 | 6/1952 | Knight | 400/202.4 |
| 4,493,572 | 1/1985 | Van Ocker et al. | 400/196.1 |
| 4,653,947 | 3/1987 | Echols | 400/196.1 |
| 5,005,996 | 4/1991 | Paterra et al. | 400/196.1 |

FOREIGN PATENT DOCUMENTS

| | | | |
|---|---|---|---|
| 15778 | 1/1988 | Japan | 400/197 |

*Primary Examiner*—Edgar S. Burr
*Assistant Examiner*—Ren Yan
*Attorney, Agent, or Firm*—John A. Brady

[57] ABSTRACT

A cartridge ribbon (2) for impact printing containing an endless ribbon (4) initially carrying ink having dye as its only coloring matter. The initial dye is in heavy enough quantity to permit infrared readability of bar codes printed by the ribbon. Re-inking reservoir (16) transfers ink through drive gear (10) only to the track (28) which is impacted during printing. The ink in the reservoir is colored with carbon black. Bar code functioning is maintained by the carbon black added by re-inking. This limited presence of carbon black does not hamper ribbon feed unacceptably, while a ribbon with a full carbon-black ink would not feed well.

6 Claims, 1 Drawing Sheet

RIBBON CARTRIDGE HAVING HYBRID INK RE-INKING

Technical Field

This invention relates to printer fabric ribbon cartridges containing an ink reservoir to supply additional ink to the ribbon during use. More specifically, the invention has advantages for the ribbon being suited to print bar code characters to be sensed using infrared radiation.

BACKGROUND OF THE INVENTION

When used in this specification "dye" means coloring matter in liquid form and "pigment" means coloring matter in particulate form.

Conventional dyes used in fabric printer ribbons are not well suited for printing bar code for infrared sensing. A ribbon can be initially loaded at the factory with sufficient dye so that bar code printed can be sensed conventionally, the dye being, for example, conventional nigrosine dye. Replenishment of such high loading of dye by re-inking in a cartridge has not been possible, and this is complicated by the fact that conventional dye-based inks tend to become much more viscous over time.

Dye, rather than pigment, in such inks provides advantages in the feeding of the ribbon. Ribbon with dye feeds more easily than ribbons with pigments. Such ribbons typically are packed or stuffed together in folds in a chamber of a cartridge. Dye permits the back pressure of the ribbon to be higher for the same resistance to feeding. Pigments add to the overall stiffness of the ribbon, which increases stuffing and ribbon movement problems.

Increased flow resistance and coefficient of friction from pigments result in increased back pressure on the ribbon, which leads to ribbon jams. Feeding typically is by opposed, intermeshed gears or pinch rollers, and high tensions can damage the ribbon both at the drive gears and at the printhead since the ribbon typically moves past the printhead. Similarly, the ribbon may slip at the drive gears, resulting in light, inconsistent printing and fabric damage which can lead to complete ribbon feed failure.

Pigments, such as carbon black, are well suited to printing bar code to be sensed conventionally using infrared radiation. It is generally known that particulate coloring matter such as pigments in conventional printer ribbons do not migrate, and that characteristic is a factor in this invention.

This invention employs re-inking on the print track only. The mechanism for such re-inking was invented prior to this invention, and is described in U.S. Pat. No. 5,015,108; a continuation of patent application Ser. No. 360,182, filed June 1, 1989, by J. H. Paterra, et al, and entitled "Ribbon Print Track Reinking with a Roll System." The presence of dye in the fabric seems to replenish the print track and extend ribbon life, and the ribbon is suitable for general purpose uses as well as for bar code applications.

DISCLOSURE OF THE INVENTION

In accordance with this invention, a primarily pigment-colored ink is applied at just the location of printing by re-inking in the cartridge of a ribbon which was initially heavily loaded with a primarily dye-based ink. In this manner advantages of both the dye and the pigment are realized since the ribbon will function with a higher pressure more characteristic of a dye-only ribbon, thus permitting additional ribbon length in a stuffed cartridge as compared to a ribbon using pigment based ink in the fabric.

The dye in the initial ribbon is sufficiently heavy to permit adequate bar code printing for conventional sensing. The pigment in the re-inked ribbon continues to make possible bar code printing for conventional infrared sensing. The ribbon feeds well and the increased length made possible by this invention distributes wear to thereby provide increased useful life of the ribbon.

BRIEF DESCRIPTION OF THE DRAWING

The details of this invention will be described in connection with the accompanying drawing, in which.

BEST MODE FOR CARRYING OUT THE INVENTION

Figure 1:
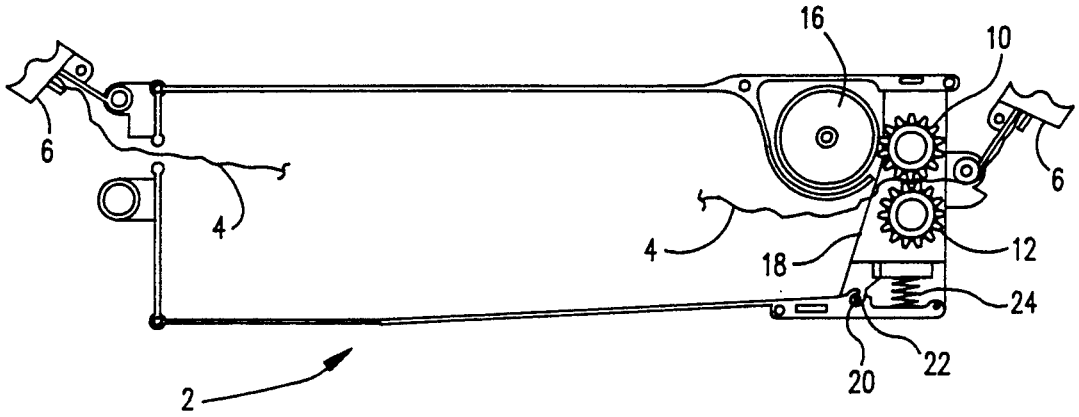
FIG. 1 shows a representative cartridge from the top and is essentially identical with one figure of the foregoing application Ser. No. 360,182.

In FIG. 1 ribbon cartridge 2 is shown with its top removed containing endless ribbon 4, of ink impregnated nylon fabric as will be discussed in detail below. Endless ribbon 4 is fed by a flexible ribbon guide 6 to printing mechanism, not shown, for transfer of ink on the endless ribbon 4 to a print medium, normally paper. Drive rollers or gears 10 and 12 physically engage ribbon 4 and stuff ribbon 4 into the cartridge 2. Ink reservoir 16 is positioned proximate to drive gear 10.

Idler gear 12 is biased into engagement with endless ribbon 4 which is pressed into contact with drive roller 10, engaging ribbon 4 in the interlocking teeth of gears 10 and 12. Idler gear 12 is rotatably mounted on a bracket 18 which has a protruding arm 20 with a rounded bearing surface at its extremity which fits into a socket 22 formed on the body of endless ribbon cartridge 2 to create a point of rotation for the bracket 18 and in turn for rotation of the idler gear 12 mounted thereon into engagement with drive transfer roller 10 so that the teeth of rollers 10 and 12 firmly engage ribbon 4. Spring 24 biases bracket 18.

Figure 2:
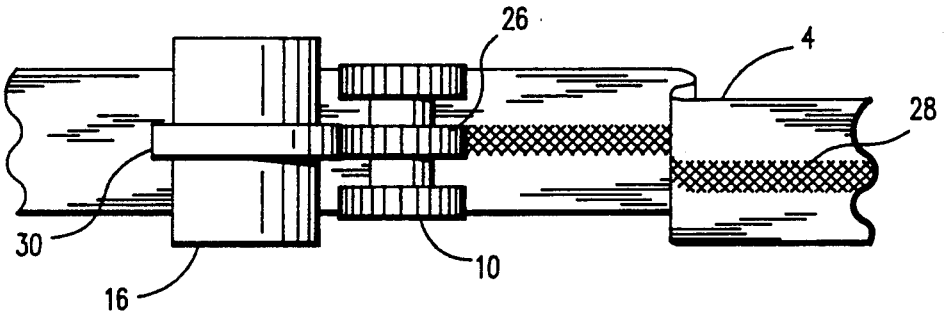
FIG. 2 shows the re-inking mechanism from the side and is essentially identical with another figure of the foregoing application Ser. No. 360,182, now abandoned.

As shown in FIG. 2, a central track 28 on ribbon 4 is the only portion of ribbon 4 which is re-inked. Track 28 is that portion of ribbon 4 from which printing is effected during the ordinary and intended use of cartridge 2. Printing from the ribbon 4 is by impact, and the point of impact, as by wires of a wire matrix printer, not shown, will only touch track 28.

Ink reservoir 16 has a raised center portion 30 which contacts the center portion 26 of drive gear 10 at the portion which contacts ribbon 4 at track 28. Reservoir 16 is mounted for rotation on an axis parallel to the axis of gear 10 and is rotated through the pushing action of gear 10 as it rotates. Reservoir 16 and its raised center 30 is a continuous, porous matrix containing liquid ink which is expressed by pressure onto gear 10 where gear 10 contacts center portion 30. Such porous re-inking members are commercially available and may be obtained commercially of size, shape, and within a range of characteristics as specified by the purchaser.

Rotation of drive roller 10 is translated by contact with center portion 30 to rotate reservoir 16. Ink in reservoir 16 is expressed into gear 10 at the area of contact, which is coextensive in width with the track 28. As gear 10 rotates, the part freshly inked by contact with portion 30 contacts track 28 and only track 28 of ribbon 4 is re-inked.

The foregoing discussion of this best mode is a prior invention. In accordance with this invention, the ribbon 4 is originally inked at the factory with an ink colored only with a dye. Specifically, ribbon 4 is 4.8 mil (approximately 0.0122 cm) textured, 14.3 mm wide nylon fabric and the ink formulation is generally as follows 0–35% black oleate, 0–25% violet oleate, 0–25% yellow oleate, 15–85% fatty acid vehicle. Reservoir 16 contains a carbon pigmented ink of generally the following formula: 15–85% fatty acid vehicle, 3–20% carbon black, 0–25% violet oleate, 0–25% yellow oleate 0–25% black oleate. The foregoing are general formulas since neither has been optimized for a specific application at this time.

These dual formulas improve performance while achieving the necessary infrared readability. As the ribbon 4 is re-inked, only the center portion receives the carbon ink. Since particulate inks do not migrate readily, the carbon ink remains concentrated only in the center of the ribbon.

This allows the ribbon to continue to function properly as a general purpose ribbon through an extended period. The ink in the initial ribbon has enough infrared readability initially to be acceptable for printing bar codes. Since the carbon ink is being deposited from the first use for printing, no lapse occurs in the infrared readability. High quality infrared bar code readability is experienced through roughly one half of the useful life for text printing. The dye seems to replenish the print track to provide extended general purpose life over that of a ribbon having only a predominantly pigmented ink. Since the feeding problems are resolved by having a dye based ink on much of the ribbon 4, approximately ⅔rds in this preferred embodiment, the length of the ribbon 4 does not have to be drastically reduced. For this preferred embodiment, this invention functions with 23 yards of ribbon 24. This compares with 25 yards in the corresponding embodiment which is entirely dye based, and with less than 16 yards, with only marginal functionality, for the corresponding embodiment which is fully carbon based.

The usable fabric length relates directly to fabric and weld wear. Since there is more fabric present and the ribbon functions properly, better print quality and longer life are achieved as well. The two inks could be used just to achieve a dense color in the printing, without regard to bar code readability. Other variations from the embodiment described will be apparent or can be anticipated, all within the spirit and scope of this invention.

We claim:

1. A cartridge ribbon for impact printing comprising an endless ribbon carrying an ink having dye as its only coloring matter, a source of ink having pigment as its primary coloring matter, and means to re-ink said ribbon within said cartridge during normal by applying said ink from said source to a band of said ribbon less in width than the width of said ribbon, said band constituting an area directly impacted for impact printing, said ribbon having initial amounts of said ink having dye as its only coloring matter in sufficient loading to print bar code detectable by infrared sensing.

2. The cartridge ribbon as in claim 1 also comprising a first drive roller and a second drive roller contacting said ribbon on opposite sides of said ribbon to stuff and feed said ribbon in said cartridge and in which said means to re-ink comprises a rotatable, porous re-inking reservoir containing said ink having pigment contacting one of said drive rollers and expressing ink on to said contacted drive roller.

3. The cartridge ribbon as in claim 1 in which said pigment is carbon black.

4. The cartridge ribbon as in claim 2 in which said pigment is carbon black.

5. An impact printer ribbon cartridge comprising a reinked endless fabric ribbon having a substantially only dye colored ink over at least one half of its width, the remaining portion of said width being a band extending the length of said ribbon, said band containing some of said dye colored ink and a primarily pigment based ink, and means in said cartridge to re-ink said ribbon only on said band with said primarily pigment based ink.

6. The ribbon cartridge of claim 5 in which the pigment of said pigment based ink is carbon black.

* * * * *